United States Patent [19]

Leclerc et al.

[11] 4,249,439

[45] Feb. 10, 1981

[54] DEVICE FOR AUTOMATICALLY TAKING OFF ELEMENTS FORMED ON PIECES, PARTICULARLY ON TOBACCO LEAVES

[75] Inventors: Jean-Francois Leclerc; Colette Desbois-Chauvette, both of Orleans, France

[73] Assignee: Service d'Exploitation Industrielle des Tabacs et des Allumettes, Paris, France

[21] Appl. No.: 6,106

[22] Filed: Jan. 24, 1979

[30] Foreign Application Priority Data

Feb. 1, 1978 [FR] France ..... 78 02752

[51] Int. Cl.[3] ..... B26D 7/18

[52] U.S. Cl. ..... 83/71; 83/80; 83/152; 83/154; 83/155.1; 83/158; 83/368; 198/412; 198/480; 198/487; 198/689

[58] Field of Search ..... 83/152, 154, 158, 71, 83/80, 155.1, 368; 198/689, 480, 487, 412; 414/744 B

[56] References Cited

U.S. PATENT DOCUMENTS

| | | | |
|---|---|---|---|
| 1,461,222 | 7/1923 | Myers | 198/689 X |
| 3,168,184 | 2/1965 | Galvin | 198/689 X |
| 3,176,558 | 4/1965 | Gustavson | 83/152 X |
| 3,252,588 | 5/1966 | Altenburger | 198/689 X |
| 3,302,803 | 2/1967 | Mooney | 198/689 X |
| 3,439,793 | 4/1969 | Rakestraw | 198/689 X |
| 3,563,377 | 2/1971 | Southcott | 198/480 X |
| 3,865,254 | 2/1975 | Johannsmeier | 198/394 X |
| 4,140,258 | 2/1979 | Gray | 83/152 X |

*Primary Examiner*—Frank T. Yost
*Attorney, Agent, or Firm*—Holman & Stern

[57] ABSTRACT

A device for automatically taking off elements drawn or formed on pieces carried by a moving support and for displacing and depositing the taken off elements on a take-up conveyor, wherein said device comprises at least one arm mounted to rotate on a shaft located between the support for the elements to be taken off and the take-up conveyor on which the taken off elements must be deposited, said arm bearing a taking off member, in principle a suction disc, mounted so as to be able to be oriented and displaced with respect to said shaft, means for driving said shaft in rotation, means for orienting and displacing the taking off member with respect to said shaft and means for controlling these latter drive means provided and arranged to ensure, in synchronism with the movements of the piece support and of the conveyor taking up the taken off elements, the taking off of all the elements formed on each piece and the deposit thereof in parallel and regular arrangement on said take-up conveyor.

4 Claims, 7 Drawing Figures

DEVICE FOR AUTOMATICALLY TAKING OFF ELEMENTS FORMED ON PIECES, PARTICULARLY ON TOBACCO LEAVES

BRIEF SUMMARY OF THE INVENTION

The present invention relates to the taking off of elements drawn or formed on pieces, particularly on tobacco leaves, which are substantially flat beneath the taking-off member. In the case of tobacco leaves, the elements which have been taken off are intended to form, for example, cigar wrappers.

The device forming the subject matter of the invention is therefore intended to grip a shape, previously cut out, from a work surface, to displace it and deposit it on another work surface. These work surfaces are constituted, on the one hand, by the support conveying the pieces, for example the tobacco leaves, on the other hand by the belt for taking up the elements taken off by the device.

In the case of taking off cigar wrappers, the leaf conveying support will have a continuous movement, for example at a speed of 15 or 30 m/min., or a discontinuous movement, and the leaf will be stopped beneath the device for 1 or 2 seconds for example.

In both cases, the controls of the supports and of the device are arranged so that the relative speeds of the leaf support of the taking off device, on the one hand, and of the device and take up conveyor, on the other hand, are zero at the moment of take off and at the moment of deposit of the wrapper.

On the leaf support, said leaves are axially aligned and their spacing is known at any instant. On the take-up conveyor, the taken off wrappers must be deposited parallel to one another at a determined pitch.

In view of the working conditions imposed, particularly of the rhythms, it has been realised that the taking off device could not be constituted by a single arm with suction disc of known type animated by a reciprocating movement, and the invention, in order to satisfy these conditions, provides that said device comprises at least one arm mounted to rotate on a shaft located between the support for the elements to be taken off and the take-up conveyor on which the taken off elements must be deposited, said arm bearing a taking off member, in principle a suction disc, mounted so as to be able to be oriented and displaced with respect to said shaft, means for driving said shaft in rotation, means for orienting and displacing the taking off member with respect to said shaft and means for controlling these latter drive means provided and arranged to ensure, in synchronism with the movements of the piece support and of the conveyor taking up the taken off elements, the taking off of all the elements formed on each piece and the deposit thereof in parallel and regular arrangement on said take-up conveyor.

The number of arms is a function of the speed. In a preferred embodiment, the device comprises four taking off arms. In this case, the arms may be mounted on the shaft at 90° with respect to one another and when an arm takes off an element, it is the diametrically opposite arm which ensures deposit on the take up conveyor.

In another embodiment, the taking off device is arranged also to cut out the elements.

In one embodiment, the taking off member is mounted at the end of a telescopic arm controlled for example by a jack. In another embodiment, it is mounted at the end of an arm in the form of compasses with opening adjustable for example by means of a jack.

BRIEF DESCRIPTION OF THE SEVERAL VIEWS OF THE DRAWING

The accompanying drawings schematically show, by way of non-limiting example, an assembly of work stations comprising cutting-out means distinct from the taking off means, said latter being constituted by devices according to the invention. In these drawings.

DETAILED DESCRIPTION

Figure 1:
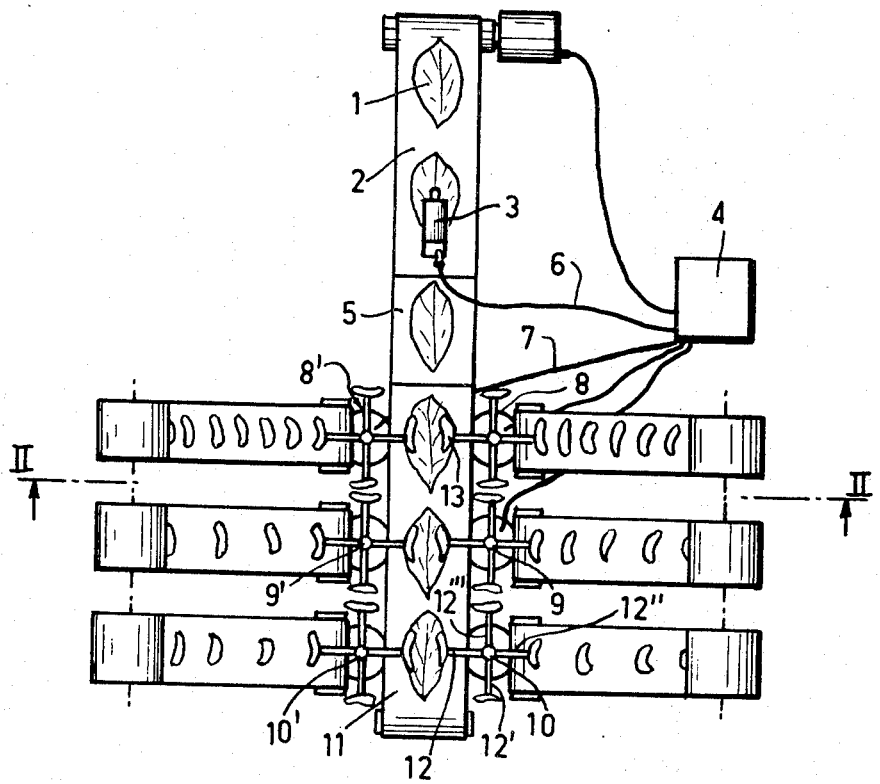
FIG. 1 is a schematic plan view of these stations.
Figure 2:
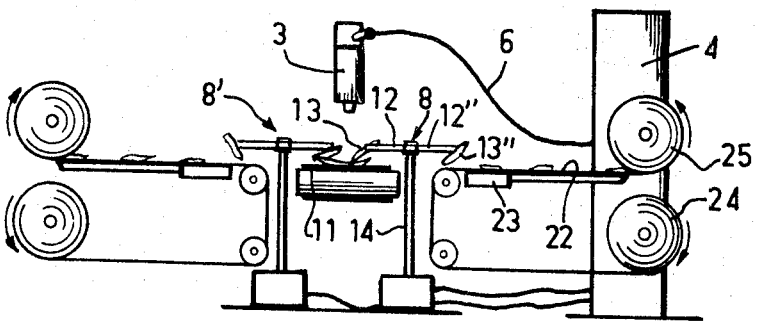
FIG. 2 is a schematic view in section along line II—II of FIG. 1.

In the example shown, the device according to the invention is associated with a line of treatment of tobacco leaves from which elements intended to constitute cigar wrappers are to be taken off.

The tobacco leaves 1 are aligned along their axis, i.e. their central rib, on a support belt 2, on principle being spaced apart by 1 m for example, therefore at a pitch P which is ideally constant, but which, in practice, is not.

These leaves 1 pass beneath a pick-up 3 which analyses the image of these leaves, each point being characterised by its coordinates and its luminous intensity. This pick-up may for example be a camera or a bar carrying photosensitive detectors.

The information from the pick-up 3 are transmitted via line 6 to a computer 4 which determines the lay-out of the wrappers to be cut out from the leaves, taking into account the defects, and using, to this end, an algorithm or programme, which does not form part of the invention. The leaves then pass beneath the cut-out station 5 of which the members (not shown) are controlled by the computer 4 via line 7. These cut-out members, of conventional type, cut out the wrappers according to the lay-out determined by the computer 4, and the leaves from which the wrappers have been cut out arrive beneath the wrapper take off station.

This station is, in the example shown, constituted by three pairs of rotary taking off members 8,8', 9,9', 10,10' disposed successively in the direction of displacement of the belt 11 supporting the leaves. The members of each pair are disposed symmetrically on either side of the belt 11, so as to effect the taking off of the wrappers of each half-leaf, respectively.

Each of the members 8,8', 9, . . . here comprises four arms (12, 12', . . . ) rotatably mounted and each bearing at its end a suction disc 13, 13', . . . This suction disc is mounted on its arm so as to be able to pivot with respect to this arm and to move away from the shaft 14 or move nearer.

Figure 4:
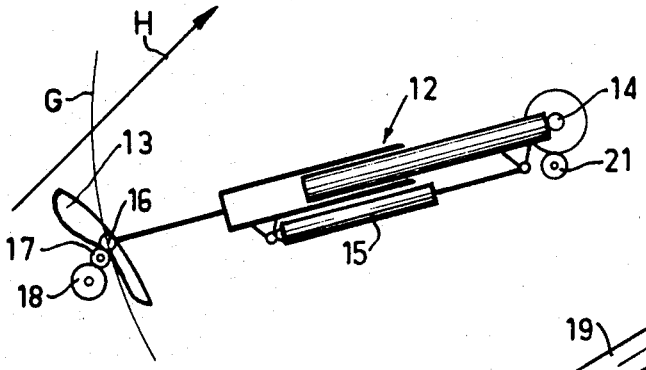
FIG. 4 is a diagram representing a sliding taking off arm.

In the embodiment shown in FIG. 4, the arm 12 is telescopic and controlled by a jack 15 and the suction disc 13 is fast with a pinion 16 meshing with a pinion 17 itself driven by a motor 18.

Figure 5:
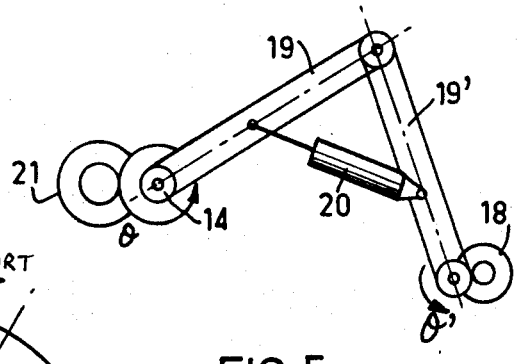
FIG. 5 is a diagram representing an arm in the form of compasses.

In the embodiment shown in FIG. 5, the arm bearing the suction disc is in the form of a pair of compasses of which the two legs 19, 19' may be moved apart by a jack 20. It is a motor 21 which controls the rotation of the shaft 14.

The motors 18 and 21 and the jacks 15 or 20 are actuated and positioned by the computer 4.

Figure 6:
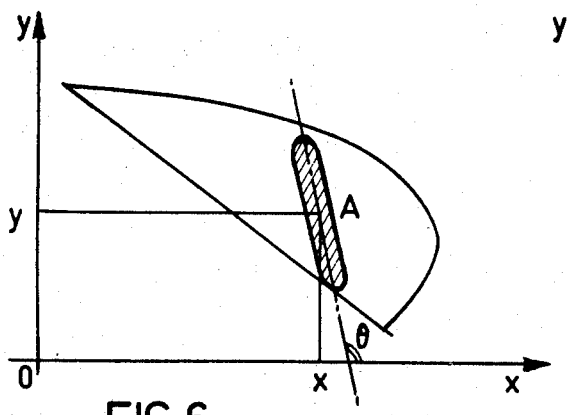
FIG. 6 is a diagram for locating the position of an element to be taken off from a half-leaf, in rectangular coordinates.
Figure 7:
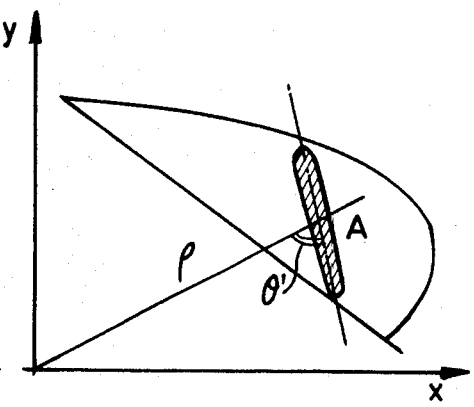
FIG. 7 is a diagram for locating this position in polar coordinates.

The elements, or wrappers, to be taken off are of constant shape and their position in a reference plane which is fixed with respect to the support belt 2 may be given by three coordinates. (x, Y, $\theta$) in rectangular coordinates (FIG. 6) or ($\rho$, $\theta$, $\theta'$) in polar coordinates (FIG. 7), (x, y) or ($\rho$, $\theta$) being the coordinates of a central point (A) of the wrapper (C) and ($\theta$) or ($\theta'$) being the angle of inclination of the axis (central D) of the wrapper (C) with respect to the x-axis (FIG. 6) or to a vector OA (FIG. 7).

The cartesian or polar marks refer to the movement of the support belt 22. Once the leaf is engaged on the belt, a mark is attached to it. The x-axis may be any one, but this may for example be the central rib, the y-axis then being the axis perpendicular to the x-axis. This mark then remains fixed with respect to the leaf and as the leaf does not move along the conveyor belt, it is attached to the axis of said conveyor. However, at the moment of taking off, the mark is attached to the rotary arm. Operation is thus effected only in variations with respect to a single mark, this simplifying calculations and enabling a possible shift of the central rib with respect to the direction of movement of the conveyor to be withdrawn from consideration.

These coordinates of the elements to be taken off are determined by the computer 4 at the moment of layout of the wrappers in the leaves, then they are delivered by this same computer to be directly exploitable by the control logic of the taking off members. This logic is not shown in the drawing; it may be coupled with the computer 4 or be mounted on each taking off member.

Figure 3:
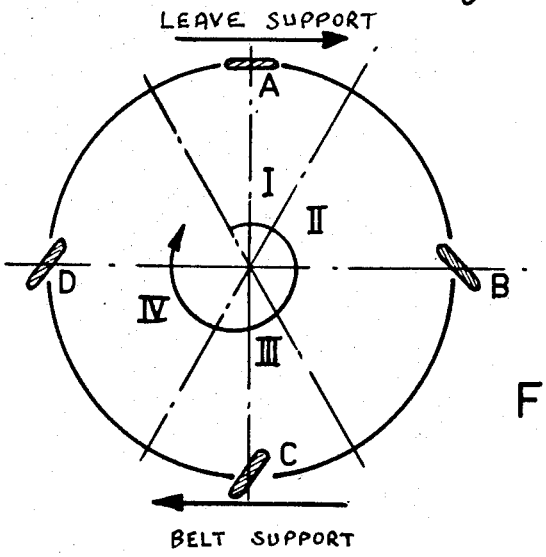
FIG. 3 is a diagram indicating the movement of the suction disc of a taking off arm.

The control logic of each member is arranged so that each arm (12, 12', . . . ) of the member has its suction disc 13 in position of taking off of a wrapper at the moment when the arm is above a leaf carried by the support belt 2 (position A (FIG. 3), then in position of deposit of the taken off wrapper on the take-up belt 22 when the arm arrives above this belt (position C—FIG. 3). In addition, the logic controls the movements of the suction disc 13 so that the position of the suction disc is always the same with respect to the belt 22 at the moment of this deposit, i.e. so that the wrappers deposited on the belt 22 are all parallel to one another.

A suction box 23 is arranged beneath the perforated take-up belt 22 which, coming from roller 24, winds on roller 25. The wrappers released by the suction disc of arm 12' are retained on the belt 22 up to the end of the box 23, then are maintained between the marks of the belt 22 on the roller 25. The transfer of the wrapper from the suction disc to the belt is facilitated by a compromise between the suctions of each of these elements.

The functioning of the device results from the above.

It may be admitted that there are, for example, three wrappers to be taken off per half-leaf and three taking off posts 8,8', 9,9', 10,10' have been provided, disposed successively on each side of the belt 2, each of these stations comprising four rotary taking off arms.

Between the passages of each half-leaf, the arms 12 . . . make a quarter turn and await the leaf from which they are to take off a wrapper.

As has been diagrammatically indicated in FIG. 3, the taking off elements stop in the determined waiting zones and the coordinates communicated to the suction disc of the rotary arm by the computer evolve so that this suction disc remains in a fixed direction with respect to the support.

If the movement is continuous, the corrections of coordinates are imposed on the taking off member so that the suction disc follows the actual movement of the wrapper and not the circular movement of the taking off member. FIG. 4 schematically indicates a part of the arc of circle G followed by the pinion 16 fast with the suction disc 13, and a part H of the rectilinear path of the wrapper to be taken off. It is seen that the suction disc 13 must, at the moment of taking off, follow a chord H of circle G.

In the case of the arm shown in FIG. 4, the movement of the suction disc is controlled to this end by the jack 15 which reduces the length of the arm 12 and by the motor 18 which causes the orientation of the suction disc to vary with respect to this arm.

In the case of the embodiment of FIG. 5, the variation of spacing between the pinion 16 of the suction disc and the shaft 14 of the arm is controlled by the jack 20 and the orientation of the suction disc with respect to the arm by the motor 18.

In a discontinuous movement, the suction disc will be automatically positioned on the chord H of the large circle G at the point of stopping of the wrapper to be taken off.

At the moment of depositing the wrapper on the take-up belt 22, the taking off arm must stop above this belt if the movement is discontinuous. If the continuous movement is adopted at the moment of deposit, the belts 2 and 22 must then be parallel, then the taking off arm will also achieve by a movement controlled by the motors 18 and 15 or 20 making it possible, at the point of reference of the wrapper to follow the chord of the large circle corresponding to the continuous movement of the wrapper support belt.

What we claim is:

1. A device for automatically taking off elements drawn or formed on pieces carried by a moving support and for displacing and depositing the taken off elements on a take-up conveyor of the type comprising at least one arm mounted to rotate on a shaft located between the support for the elements to be taken off and the take-up conveyor on which the taken off elements must be deposited, each arm bearing a suction disc taking off member wherein said device further comprises means for determining the lay-out of the elements to be taken off of each piece and transmitting said lay-out to a control means, means for positioning and orienting the taking off member with respect to said shaft, and said control means being means for controlling said positioning and orienting means in accordance with the instructions received from said lay-out determining means, whereby the position and orientation of the element to be taken off corresponds to the position and orientation of the take off member of said arm, and drive means arranged to operate in synchronism with the movements of the pieces carried by the moving support and of the take-up conveyor to take off the elements formed on each piece and deposit them in parallel and regular arrangement on said take-up conveyor.

2. A device as claimed in claim 1, wherein means are provided to effect the cutting out of the elements.

3. A device as claimed in claim 1, wherein the taking off member is mounted at the end of a telescopic arm controlled by a jack means.

4. A device as claimed in claim 1, wherein the taking off member is mounted at the outer end of an articulated linkage comprising two leg members pivotally connected together at one end with the opening of said outer end being adjustable by a jack means connected to said legs.

* * * * *